US008882394B2

(12) United States Patent
Aksel et al.

(10) Patent No.: US 8,882,394 B2
(45) Date of Patent: Nov. 11, 2014

(54) TENSIONER CYLINDER CONNECTIONS WITH MULTIAXIAL DEGREES OF FREEDOM

(75) Inventors: Bulent Aksel, Houston, TX (US); Joseph William Pallini, Jr., Tomball, TX (US); Steven Matthew Wong, Houston, TX (US); Philip John Potter, Houston, TX (US); Chijie Lin, Sugar Land, TX (US)

(73) Assignee: Vetco Gray Inc., Houston, TX (US)

( * ) Notice: Subject to any disclaimer, the term of this patent is extended or adjusted under 35 U.S.C. 154(b) by 174 days.

(21) Appl. No.: 13/588,812

(22) Filed: Aug. 17, 2012

(65) Prior Publication Data

US 2013/0115012 A1 May 9, 2013

Related U.S. Application Data

(60) Provisional application No. 61/557,231, filed on Nov. 8, 2011.

(51) Int. Cl.
*E21B 19/09* (2006.01)
*E21B 19/00* (2006.01)

(52) U.S. Cl.
CPC ..... *E21B 19/002* (2013.01)
USPC ..... 405/224.4

(58) Field of Classification Search
CPC . E21B 19/004; E21B 19/006; B63B 35/4413; B63B 35/44
USPC ..... 405/224.2, 224.3, 224.4; 166/345
See application file for complete search history.

(56) References Cited

U.S. PATENT DOCUMENTS

| | | | | | |
|---|---|---|---|---|---|
| 3,508,409 | A * | 4/1970 | Cargile, Jr. | ..... | 405/195.1 |
| 4,362,438 | A * | 12/1982 | Spink | ..... | 405/195.1 |
| 4,787,778 | A * | 11/1988 | Myers et al. | ..... | 405/224.4 |
| 4,799,827 | A * | 1/1989 | Jaqua | ..... | 405/224.4 |

(Continued)

FOREIGN PATENT DOCUMENTS

| | | | | |
|---|---|---|---|---|
| EP | 0270336 | A2 | 6/1988 | |
| GB | 2488036 | A | 8/2012 | |
| WO | 2004013452 | A1 | 2/2004 | |
| WO | WO 2009064941 | A2 * | 5/2009 | ..... E21B 19/00 |

OTHER PUBLICATIONS

Search Report from corresponding GB Application No. GB1219951.9 dated Jan. 23, 2013.

*Primary Examiner* — Tara M. Pinnock
(74) *Attorney, Agent, or Firm* — Bracewell & Giuliani LLP

(57) ABSTRACT

A coupler having two degrees of axial freedom couples a hydro-pneumatic cylinder to a tensioner ring of a riser tensioner mounted to a platform. A post extends along an axis of the cylinder and an intermediate sleeve is disposed around the post to form a post annulus. An outer sleeve is secured to the tensioner ring and defines a cavity into which the post and intermediate sleeve are inserted so that an annulus is formed between the sleeve and the outer sleeve. The Outer sleeve is coupled to the intermediate sleeve so that the outer sleeve may pivot on the coupling between the outer sleeve and the intermediate sleeve relative to the intermediate sleeve. The intermediate sleeve is coupled to the post so that the intermediate sleeve may pivot on the coupling between the intermediate sleeve and the post relative to the post.

19 Claims, 5 Drawing Sheets

(56) References Cited

U.S. PATENT DOCUMENTS

| | | | | |
|---|---|---|---|---|
| 4,883,387 | A * | 11/1989 | Myers et al. | 405/224.4 |
| 7,988,385 | B2 | 8/2011 | Pallini et al. | |
| 8,011,858 | B2 | 9/2011 | Pallini et al. | |
| 8,141,644 | B2 | 3/2012 | Ellis | |
| 2007/0196182 | A1 | 8/2007 | Ellis | |
| 2008/0031692 | A1 * | 2/2008 | Wybro et al. | 405/224.4 |
| 2009/0145611 | A1 * | 6/2009 | Pallini et al. | 166/355 |
| 2012/0207550 | A1 * | 8/2012 | Aksel et al. | 405/224.4 |

* cited by examiner

TENSIONER CYLINDER CONNECTIONS WITH MULTIAXIAL DEGREES OF FREEDOM

The application claims the benefit of and priority to U.S. Provisional Patent Application No. 61/557,231, filed Nov. 8, 2011, entitled "Tensioner Cylinder Connections with Multi-axial Degrees of Freedom" to Aksel, et al., which application is hereby incorporated by reference in its entirety.

BACKGROUND OF THE INVENTION

1. Field of the Invention

The present invention relates in general to marine riser tensioners and, in particular, to a push up tensioner that accommodates riser tilt with tensioner cylinder connections with multiaxial degrees of freedom.

2. Brief Description of Related Art

Offshore production platforms must support production risers from oil or gas wells that extend to the platform from subsea wells. For platforms that are fixed to the ocean floor this is readily accomplished and is well known in the art. However, for subsea completions in deep water that require the use of floating platforms, such as tension leg platforms (TLPs) or semi-submersible platforms, supporting risers present significant problems. These platforms move under the influence of waves, wind, and current and are subjected to various forces. Thus, the riser tensioning mechanism must permit the platform to move relative to the riser.

The riser tensioning mechanism must also maintain the riser in tension so that the entire weight of the riser is not transferred, to the wellhead and so that the riser does not collapse under its own weight. The tensioning mechanism must therefore exert a continuous tensional force on the riser. Also, this force must be maintained within a narrow tolerance.

Push up tensioners have several advantages in subsea applications, one being that the tensioner accommodates higher loads in a smaller space over other types of tensioners. This is in part because push up tensioners use a more efficient piston end and do not require a tension pulling device at the end connection. In addition, the pressure in push Up tensioners does not act on the rod side of the cylinder. Where seas are rough, and the floating platform experiences great range of vertical motion, push up tensioners are better able to accommodate that vertical motion. In addition, use of a pushup tensioner can minimize the corrosive effects of the salt-water environment in which they must operate because the high pressure seals of the tensioner are not located adjacent to the atmosphere and are isolated from caustic fluids and debris.

TLPs provide stable drilling platforms in deeper waters. In TLPs, tension legs extend from the platform down to an anchor located at the sea floor. The tension legs are relatively inelastic meaning that much of the vertical motion of the platform is eliminated. TLPs allow for location of the wellhead assembly on the surface rather than on the sea floor. A riser will typically extend from the wellhead assembly down to the sea floor. This setup allows for simpler well completion and better control of production. However, in TLPs the riser may tilt from the vertical relative to the TLP. The amount of riser tilt from the vertical is not static and varies with time during operation.

While use of both TLPs and RAM type push up tensioners is desired, because of the varying riser tilt, RAM style push-up tensioners constructed to date are not currently suitable for use with TLPs. In previous RAM systems, the cylinders remain in line with the riser, which allows for small spacing of the risers. Therefore, there is a need for a push up riser tensioner that can tilt with the riser for use in a TLP.

SUMMARY OF THE INVENTION

These and other problems are generally solved or circumvented, and technical advantages are generally achieved, by preferred embodiments of the present invention that provide a push up tensioner that accommodates riser tilt with tensioner cylinder connections with multi-axial degrees of freedom.

In accordance with an embodiment of the present invention, a tensioner for maintaining a tensile force in a riser having an axis and extending from a subsea wellhead assembly through an opening in a floating platform deck is disclosed. The tensioner includes a tensioner ring coupled to the riser, and a plurality of hydro-pneumatic cylinders, each having at least one flexible coupler on an end for coupling the cylinders between the deck and the tensioner ring. Each flexible coupler includes a lower member coupled to the cylinder, an intermediate member pivotally coupled to the lower member by a first pin, and an upper member pivotally coupled to the intermediate member by a second pin. The first pin and the second pin are spaced apart and perpendicular to each other so that the upper member may pivot on the second pin relative to the intermediate member and the lower member may pivot on the first pin relative to the intermediate member.

In accordance with another embodiment of the present invention, a tensioner for maintaining a tensile force in a riser having an axis and extending from a subsea wellhead assembly through an opening in a floating platform, deck is disclosed. The tensioner includes a tensioner ring coupled to the riser and a plurality of hydro-pneumatic cylinders, each having at least one flexible coupler on an ends for coupling the cylinders between the deck and the tensioner ring. Each flexible coupler securing the cylinders to the tensioner ring includes a post extending along an axis of the cylinder and an intermediate sleeve disposed around the post to form a post annulus. The flexible coupler also includes a tensioner ring sleeve secured to the tensioner ring and defining a cavity into which the post and intermediate sleeve are inserted so that an annulus is formed between the sleeve and the tensioner ring sleeve. The tensioner ring, sleeve is coupled to the intermediate sleeve so that tensioner ring sleeve may pivot on the coupling between the tensioner ring sleeve and the intermediate sleeve relative to the intermediate sleeve. The intermediate sleeve is coupled to the post so that the intermediate sleeve may pivot on the coupling between the intermediate sleeve and the post relative to the post.

In accordance with still another embodiment of the present invention, a tensioner for maintaining a tensile force in a riser having an axis and extending from a subsea wellhead assembly through an opening in a floating platform deck is disclosed. The tensioner includes a tensioner ring coupled to the riser, and a plurality of hydro-pneumatic cylinders, each having at least one flexible coupler on an end for coupling the cylinders between the deck and the tensioner ring. Each flexible coupler includes a cylinder adapter coupled to an end of the cylinder and having two posts extending from the cylinder adapter opposite the cylinder, an inner pivot positioned between the posts of the cylinder adapter, the first pin passing through upper ends of the post and an upper end of the inner pivot, and an adapter latch assembly having two prongs extending from a base member and a protrusion extending from the base member opposite the prongs, the second pin passing through ends of the prongs opposite the base member and a lower portion of the inner pivot. The first pin and the second pin are spaced apart and perpendicular to each other so that the cylinder adapter may pivot on the first pin relative to the inner pivot and the adapter latch assembly may pivot on the second pin relative to the inner pivot.

In accordance with another embodiment of the present invention, a coupler having two degrees of axial freedom for coupling a hydro-pneumatic cylinder to a tensioner ring for a tensioner configured to maintain a tensile force in a riser having an axis and extending from a subsea wellhead assembly through an opening in a floating platform deck is disclosed. The coupler includes a cylinder plate secured to the cylinder having a post extending along an axis of the cylinder plate opposite the cylinder and an intermediate sleeve disposed around the post to form a post annulus. The coupler also includes a tensioner ring sleeve secured to the tensioner ring and defining a cavity into which the post and intermediate sleeve are inserted so that an annulus is formed between the sleeve and the tensioner ring sleeve. The tensioner ring sleeve is coupled to the intermediate sleeve so that tensioner ring sleeve may pivot on the coupling between the tensioner ring sleeve and the intermediate sleeve relative to the intermediate sleeve. The intermediate sleeve is coupled to the post so that the intermediate sleeve may pivot on the coupling between the intermediate sleeve and the post relative to the post.

In accordance with yet another embodiment of the present invention, a method for applying tension to a riser extending through a deck of a floating offshore platform is disclosed. The method mounts a tensioner assembly having a plurality of hydro-pneumatic cylinders between the deck and the riser, and provides an articulated coupling between an end of each cylinder and a tensioner ring mounted to the riser. The articulated coupling includes mounting a post to an end of the cylinder and positions a sleeve around the post so that the post and the sleeve are coaxial about an axis of the post. The method couples the sleeve to the post so that the sleeve pivots on a first axis relative to the post. The method positions a tensioner ring sleeve around the sleeve so that the sleeve is disposed within a cavity of the coupler and couples the tensioner ring sleeve to the sleeve and post so that the tensioner ring sleeve pivots on a second axis relative to the post. The method mounts a tensioner ring to a boss of the coupler opposite the post and in response to relative motion between a riser coupled to the tensioner ring and a platform, the method pivots the cylinder on the first and second axes, An advantage of a preferred embodiment is that it provides a push up riser tensioner that can accommodate large loads on a tension leg platform (UP) using a coupler with multiple rotational degrees of freedom at the coupling of the cylinder with the tensioner ring. In addition, the disclosed embodiments are less prone to corrosion issues due to their placement above the tension leg platform deck rather than below. This also reduces the need for additional deck structure to support the riser tensioner. The disclosed embodiments also eliminate high pressure accumulation while using a smaller number of cylinders.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted in as much as such details are not considered necessary to obtain a complete understanding of the present invention, and are considered to be within the skills of persons skilled in the relevant art.

Figure 1:
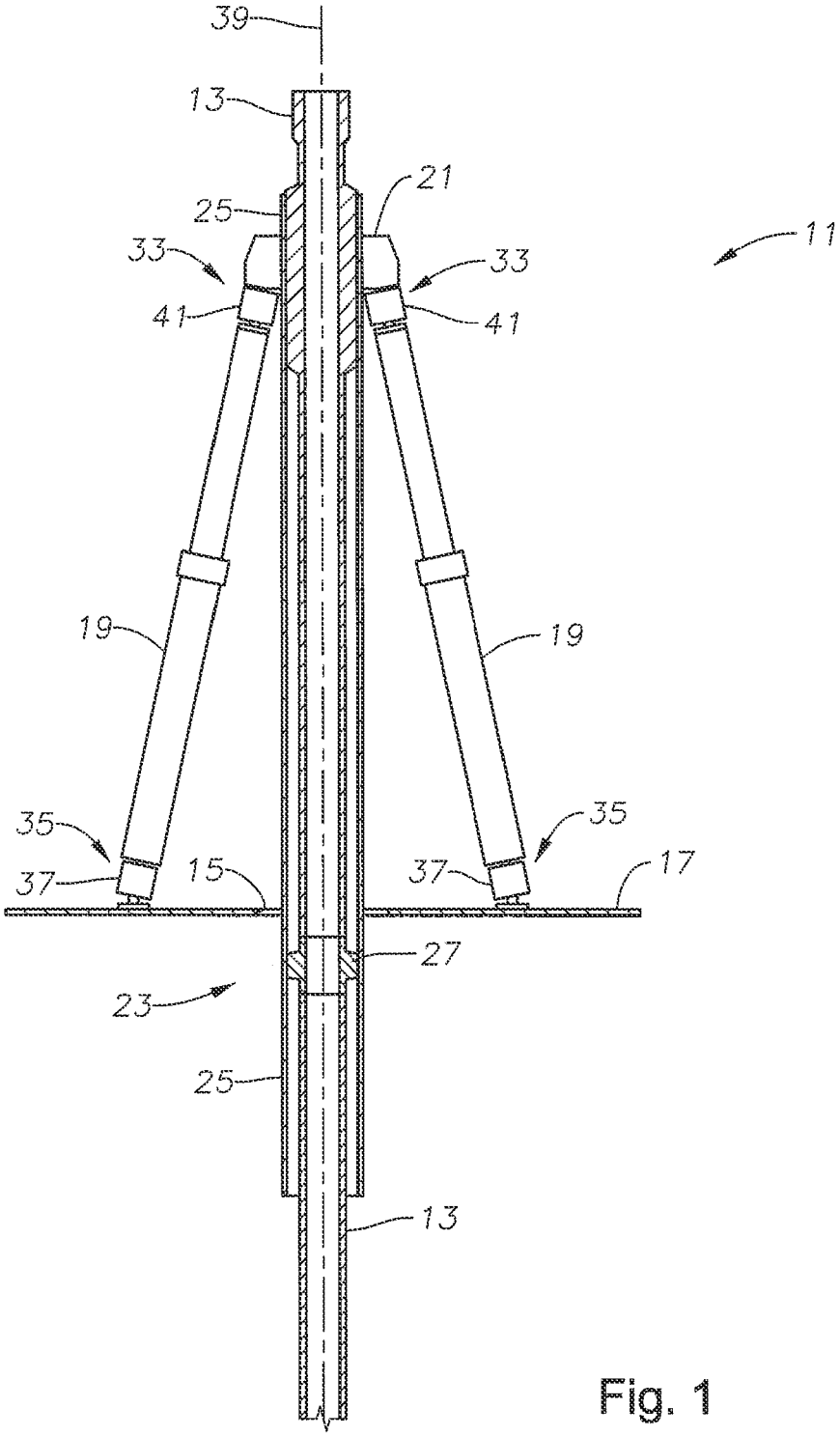
FIG. 1 is a sectional view of a riser tensioner assembly in accordance with an embodiment of the present invention.

Referring to FIG. 1, a riser tensioner assembly 11 provides tension to a riser 13 that has its lower end secured to subsea equipment such as a subsea wellhead assembly (not shown). Riser tensioner assembly 11 has a nominal tensioning position, shown in FIG. 1. Riser 13 extends upward through an opening 15 in a deck 17 of a vessel (not shown). Although moored, typically deck 17, i.e. the vessel, will move relative to riser 13 in response to current and wave motion. A plurality of cylinders 19 are supplied with hydraulic fluid and gas under pressure to provide an upward force to riser 13 to maintain a uniform tension in riser 13 as deck 17 moves relative to riser 13. In an exemplary embodiment, six cylinders 19 may be equidistantly disposed around riser 13. A person skilled in the art will understand that more or fewer cylinders 19 may he used.

A lower end 35 of each cylinder 19 couples to deck 17 and an upper end 33 couples to a tensioner ring 21. Tensioner ring 21 is an annular disc like object that may clamp to riser 13 such that tensioner ring 21 is coaxial with an axis 39 passing through riser 13. Tensioner ring 21 may also thread onto riser 13 or a riser tensioner joint as described in more detail below. A person skilled in the art will understand that riser 13 may refer to the complete riser extending between the wellhead and the drilling rig or a riser tensioner joint coupled inline with the complete riser proximate to riser tensioner assembly 11.

Lower ends 35 of cylinders 19 are placed circumferentially around opening 15. In the illustrated embodiment, lower end 35 of each cylinder 19 is coupled near an edge of opening 15, such that the diameter of a circle having an edge passing through each lower end coupling location of each cylinder 19 will be larger than the diameter of tensioner ring 21. In this manner, riser tensioner assembly 11 will not topple at the expected maximum tilt of riser 13. A person skilled in the art will understand that lower end 35 of each cylinder 19 may couple to deck 17 at a greater distance from opening 15 as needed such that lower ends 35 of cylinders 19 will not couple to deck 17 directly beneath tensioner ring 21 when riser 13 is in an un-tilted state as shown in FIG. 1. In addition, riser tensioner assembly 11 may include an anti-shift assembly or guide assembly 23 employed to guide or centralize riser 13 in opening 15. Guide assembly 23 is mounted around riser 13 while in the tensioning position for engagement with riser 13, or a component mounted to riser 13.

Guide assembly 23 may be any suitable assembly adapted to maintain the position of riser 13 centrally within opening 15. In an exemplary embodiment, guide assembly 23 includes a conductor sleeve 25 extending axially downward parallel to axis 39 and secured to tensioner ring 21. In the illustrated embodiment, conductor sleeve 25 does not contact the exterior surface of riser 13. Conductor sleeve 25 defines an annular space between the exterior surface of riser 13 and the interior surface of conductor sleeve 25. Ribs may be formed on the exterior surface of conductor sleeve 25 and extend the length of conductor sleeve 25 parallel to axis 39. As shown, an outer diameter of conductor sleeve 25 contacts an inner diameter of opening 25. Conductor sleeve 25 has sufficient material strength to resist permanent deformation or failure when experiencing a radial react force exerted by opening 15 as riser 13 tilts. An optional support ring 27 may be coupled to riser 13 within the annulus between conductor sleeve 25 and riser 13 proximate to opening 15 to provide additional lateral support to conductor sleeve 25. When riser 13 attempts to shift radially in opening 15 relative to deck 17, guide assembly 23 will exert a react force against conductor sleeve 25 to constrain the lateral shift in the radial direction. In this manner, riser 13 tilt may be accommodated without allowing for shift of riser 13 in opening 15 that may cause riser 13 to impact deck 17 damaging both deck 17 and riser 13. Guide assembly 23 may include roller assemblies (not shown) that extend from deck 17 into opening 15. The roller assemblies may interact with conductor sleeve 25 or a smaller sleeve to prevent contact of riser 13 and conductor sleeve 25 with deck. 17. In these embodiments, the outer diameter of conductor sleeve 25 will not contact the inner diameter of opening 15. Additional embodiments of guide assembly 23 may be found in commonly owned U.S. patent application Ser. No. 13/072,233, entitled "Marine Riser Tensioner", filed on Mar. 25, 2011, by Aksel et al., the disclosure of which is incorporated by reference herein in its entirety.

Each cylinder 19 has a barrel and a rod, allowing each cylinder 19 to move between a contracted position, and an extended position. In the extended position, upper end 33 of each cylinder 19 moves further from the respective lower end 35 of each cylinder 19, and in the contracted position, upper end 33 of each cylinder 19 moves closer to the respective lower end 35 of each cylinder 19. As shown, cylinders 19 are in the nominal position, neither filly contracted nor fully extended. A coupler 37 secured to lower end 35 couples each cylinder 19 to deck 17. Lower end 35 of each cylinder 19 pivotally couples to deck 17 with coupler 37. In the exemplary embodiment, cylinder 19 may pivot about the coupler 37 in one or more planes. For example, cylinder 19 may pivot on two rotational axes of each coupler 37. Similarly, each cylinder 19 couples to tensioner ring 21 with a coupler 41. As with the lower coupler 37, coupler 41 permits cylinder 19 to pivot about coupler 41. Cylinder 19 may pivot about coupler 41 in one or more planes. For example, cylinder 19 may pivot on two rotational axes of each coupler 41 as described in more detail below. In this manner, cylinder 19 may pivot in one or more planes, and preferably in at least two planes, as deck 17 moves relative to riser 13, A person skilled in the art will understand that coupler 37 may include the components of coupler 41 and operate in a similar manner, allowing for a coupler of the type described with respect to coupler 41 to be used to couple cylinder 19 to tensioner ring 21 as described below, and to couple cylinder 19 to deck 17. Still further, a person skilled in the art will recognize that in other embodiments cylinder 19 may use different types of couplers at upper end 33 and lower end 35. For example, cylinder 19 may couple to tensioner ring 21 with the disclosed coupler 41 described below and coupler 37 used to coupler cylinder 19 to deck 17 may be a bail and socket joint. Alternatively, coupler 37 used to couple cylinder 19 to deck 17 may be of the type described with respect to coupler 41, below, and coupler 41 used to couple cylinder 19 to tensioner ring 21 may be a ball and socket joint.

Pivoting at couplers 37, 41 will occur as deck 17 and riser 13 move relative to one another. Thus, as riser 13 tilts away from the vertical in relation to deck 17, tensioner ring 21 will move from the position illustrated in FIG. 1. Cylinders 19 will pivot at couplers 37, 41 to maintain connection to both deck 17 and tensioner ring 21. Each cylinder 19 will extend, contract, and pivot as needed to remain coupled with tensioner ring 21 and deck 17. Similarly, as riser 13 tilts, each cylinder 19 will contract, expand, and pivot as necessary to exert a tensioning force on riser 13.

Figure 2:
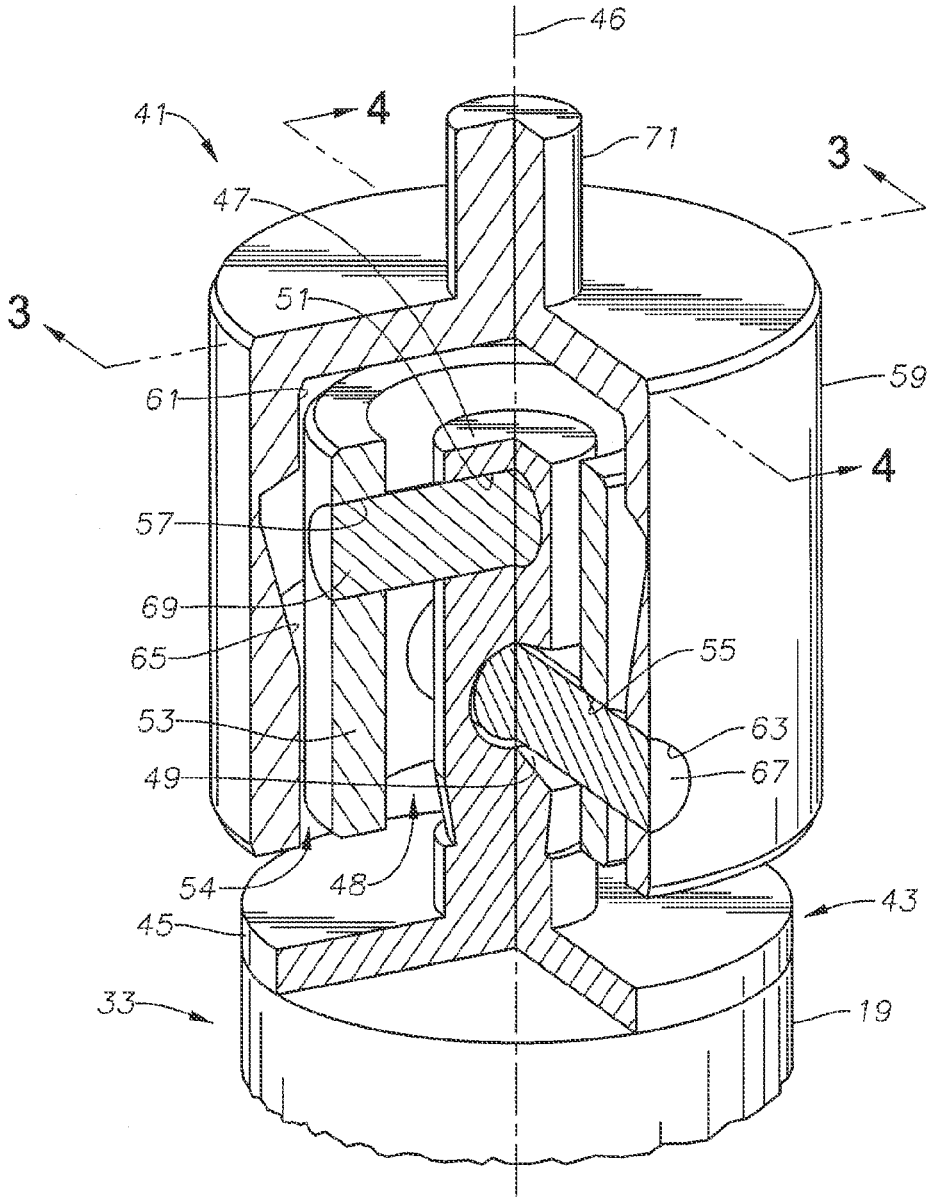
FIG. 2 is a cutaway view of a cylinder connector of the riser tensioner assembly of FIG. 1.

Referring to FIG. 2, a sectional cutaway view of coupler 41 is shown. Coupler 41 may be in an unarticulated position, illustrated with respect to FIG. 2, 3A, and 4A or an articulated position as shown with respect to FIGS. 3B and 4B. The articulated position corresponds with tilt of riser 13 relative to deck 17. As shown in FIG. 2, coupler 41 includes a base portion 43 that secures to upper end 33 of cylinder 19. In the illustrated embodiment, base portion 43 includes a cylinder plate 45 having an outer diameter substantially equivalent to the outer diameter of cylinder 19 at upper end 33. Cylinder plate 45 may have a plurality of boreholes formed therein for passage of bolts or other connectors to secure cylinder plate 45 to upper end 33 of cylinder 19. A post 47 protrudes from cylinder plate 45 opposite cylinder 19. In the exemplary embodiment, post 47 is coaxial with an axis 46 of cylinder plate 45. Post 47 defines two bores, a post cylinder bore 49 and a post tensioner ring bore 51. Both bores pass through post 47 perpendicular to post 47 and parallel to a surface of post cylinder plate 45. Post cylinder bore 49 and post tensioner ring bore 51 are orthogonal to each other and spaced axially so that cylinder bore 49 is proximate to upper end 33 of cylinder 19, and post tensioner ring bore 51 is near an end of post 47 proximate to tensioner ring 21 (FIG. 1).

As shown in FIG. 2, an intermediate sleeve 53 is disposed around post 47. In the illustrated embodiment, intermediate sleeve 53 has an inner diameter larger than the outer diameter of post 47 so that an annulus 48 is formed between intermediate sleeve 53 and post 47. Intermediate sleeve 53 also defines two bores, a sleeve cylinder bore 55 and a sleeve tensioner ring bore 57. Sleeve cylinder bore 55 and sleeve tensioner ring bore 57 are coaxial with cylinder bore 49 and post tensioner ring bore 51, respectively. A tensioner ring sleeve 59 defines a coupler cavity 61 and is disposed around intermediate sleeve 53 and post 47. Cavity 61 has an inner diameter larger than the outer diameter of intermediate sleeve 53 so that an annulus 54 is formed between the inner diameter of cavity 61 and the outer diameter of intermediate sleeve 53. Tensioner ring sleeve 59 will further couple to tensioner ring 21 (FIG. 1) through boss 71 formed on an outer surface of tensioner ring sleeve 59. Tensioner ring sleeve 59 also defines a coupler cylinder bore 63 and a conical coupler tensioner ring recess 65. Coupler cylinder bore 63 is substantially coaxial with sleeve cylinder bore 55 and post cylinder bore 49 such that a cylinder pin 67 may pass through coupler cylinder bore 63, sleeve cylinder bore 55, and post cylinder bore 49. A person skilled in the art will recognize that post cylinder bore 49, sleeve cylinder bore 55, and coupler cylinder bore 63 are in alignment, but not necessarily coaxial. In the illustrated embodiment, sleeve cylinder bore 55 and coupler cylinder bore 63 are coaxial. A tensioner ring pin 69 may pass through sleeve tensioner ring bore 57 and post tensioner ring bore 51. A person skilled in the art will recognize that sleeve tensioner ring bore 57 and post tensioner ring bore Si are coaxial. When passed through their respective bores, cylinder pin 67 and tensioner pin 69 will be perpendicular to one another and spaced axially.

In other embodiments, cylinder pin 67 may be one or more pins, for example two pins adapted to insert into post cylinder bore 55 from opposing sides. The two cylinder pins 67 may abut near a medial portion of post cylinder bore 49, allowing for some additional articulation of post 47 relative to intermediate sleeve 53.

Figure 4A:
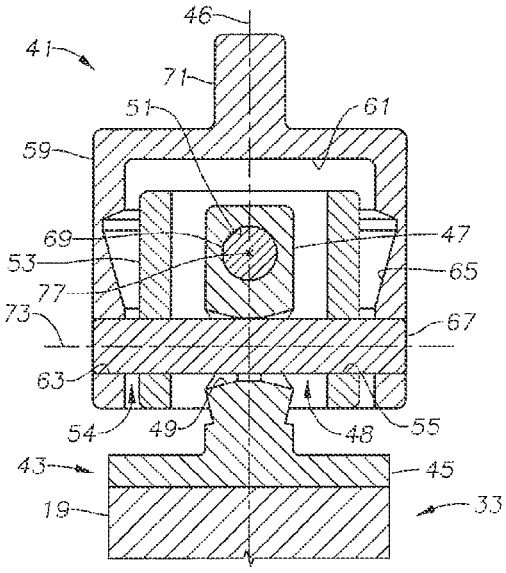
FIG. 4A is an unarticulated sectional view of the cylinder connector of FIG. 2 taken along line 4-4.

Referring to FIGS. 4A, post cylinder bore 49 formed in post 47 has a diameter near a center of post 47 that is ovoid in shape, having a width approximately equal to the diameter of sleeve pin 67 and a height larger than the diameter of sleeve pin 67 so that sleeve pin 67 may move axially within post cylinder bore 49 toward and away from a proximate surface of cylinder plate 45. The diameter of post cylinder bore 49 will increase as post cylinder bore 49 extends front a center of post 47 to an outer surface of post 47. The diameter of post cylinder bore 49 will generally he aligned with axis 73 passing through a center of cylinder pin 67. Thus, post cylinder bore 49 will have a generally conical shape with a larger diameter at the surface of post 47 and a smaller diameter near a center of post 47, as shown in FIG. 4A. Sleeve cylinder bore 55 has a diameter approximately equal to the diameter of sleeve pin 67 so that cylinder pin 67 may pass through sleeve cylinder bore 55 with little to no movement of cylinder pin 67 relative to sleeve cylinder bore 55. In an embodiment, sleeve cylinder bore 55 and sleeve tensioner ring bore 57 in intermediate sleeve 53 have a nitronic sleeve that is shrunk fit into position. Coupler cylinder bore 63 has a diameter approximately equal to the diameter of sleeve pin 67 so that cylinder pin 67 may pass through coupler cylinder bore 63 with little to no axial movement of cylinder pin 67 within coupler cylinder bore 63.

Figure 3A:
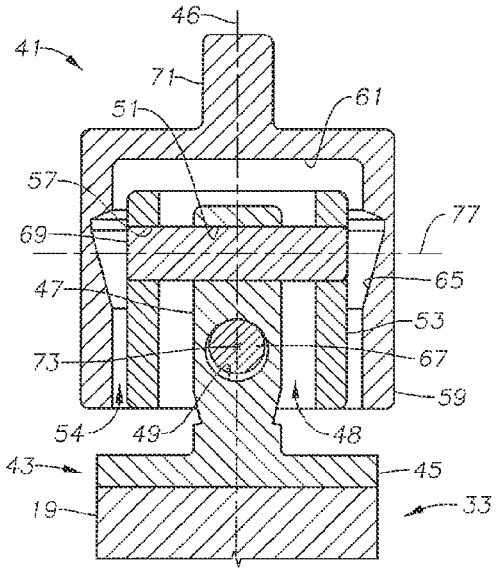
FIG. 3A is an unarticulated sectional view of the cylinder connector of FIG. 2 taken along line 3-3.

Referring to FIG. 3A, post tensioner ring bore 51 has a diameter substantially equivalent to a diameter of tensioner pin 69 so that tensioner pin 69 May pass through post tensioner ring bore 51 with little to no axial movement of tensioner ring pin 69 within post tensioner ring bore 51. Sleeve tensioner ring bore 57 has a diameter substantially equivalent to a diameter of tensioner pin 69 so that tensioner pin 69 may pass through sleeve tensioner ring bore 57 with little to no axial movement of tensioner ring pin 69 within sleeve tensioner ring bore 57.

Coupler tensioner ring recess 65 is a conical profile formed in an inner diameter of cavity 61 of coupler 59. Coupler tensioner ring recess 65 is axially aligned with sleeve tensioner ring bore 57 and post tensioner ring bore 51. Coupler tensioner ring recess 65 has a conical profile with an inner diameter that increases as coupler tensioner ring recess 65 depends upward. As described in more detail below, coupler 59 may pivot relative to intermediate sleeve 53 so that an end of intermediate sleeve proximate to tensioner ring 21 (FIG. 1) may fit within coupler tensioner ring recess 65. A person skilled in the art will recognize that coupler tensioner ring recess 65 will have a sufficient axial height to accommodate the upper end of intermediate sleeve 53.

As described herein, coupler 41 is experiencing a Compressive loading along axis 46 of boss 71 and post 47. Referring to FIG. 3A, in the unarticulated position tensioner ring pin 69 will experience load transfer with post 47 through post tensioner ring bore 51. Tensioner ring pin 69 will experience load transfer with intermediate sleeve 53 through sleeve tensioner ring bore 57. Referring to FIG. 4A, cylinder pin 67 will experience load transfer with intermediate sleeve 53 through sleeve cylinder bore 55. Cylinder pin 67 will experience load transfer with coupler 59 through coupler cylinder bore 63. Thus, the compressive load applied to cylinders 19 (FIG. 1) by riser 13 (FIG. 1) may transfer from coupler 59 through coupler cylinder bore 63 to cylinder pin 67 and from cylinder pin 67 through sleeve cylinder bore 55 to intermediate sleeve 53. The compressive load may then be transferred from intermediate sleeve 53 to tensioner ring pin 69 through sleeve tensioner ring bore 57 and from tensioner ring pin 69 to post 47 through post tensioner ring bore Si. The load may then be transferred down post 47 and into cylinder 19.

Figure 3B:
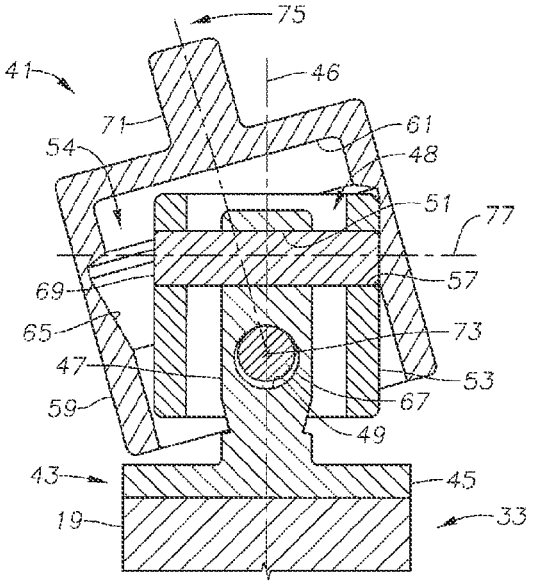
FIG. 3B is an articulated sectional view of the cylinder connector of FIG. 3.
Figure 4B:
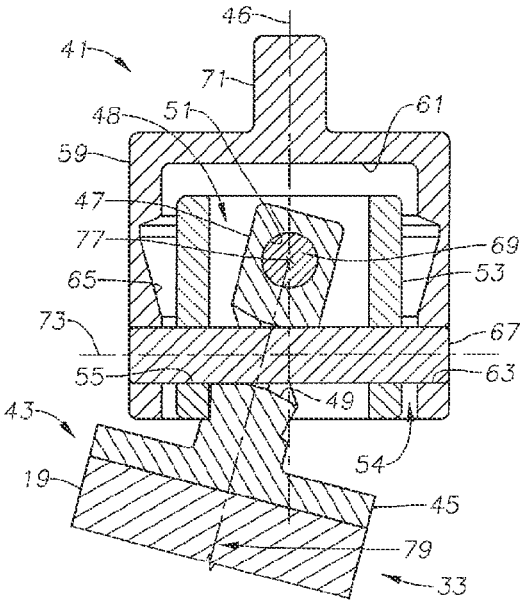
FIG. 4B is an articulated sectional view of the cylinder connector of FIG. 4A.

Referring to FIGS. 3B and 4B, two articulated positions of coupler 41 are shown. As shown in FIG. 3B, tensioner ring sleeve 59 is rotated on an axis 73 of cylinder pin 67 as indicated by arrow 75. Rotation 75 may be caused by movement of tensioner ring 21 in response to tilt of riser 13. Annulus 54 allows for relative moment between coupler 59 and intermediate sleeve 53, accommodating rotation 75. As shown in FIG. 3B, when coupler 59 rotates relative to intermediate sleeve 53 on axis 73 of cylinder pin 67, an upper end of intermediate sleeve 53 will fit within recess 65. Loading of coupler 41 will be similar to that described above, in that load from coupler 59 will transfer through cylinder pin 67 to intermediate sleeve 53. The relative surfaces of the contacting members will maintain contact such that the compressive loads applied to coupler 41 may be transferred as described above.

As shown in FIG. 4B, cylinder plate 45 is rotated on an axis 77 of tensioner ring pin 69 as indicated by arrow 79. Rotation 79 may be caused by movement of deck 17 relative to riser 13. Annulus 48 allows for relative movement between intermediate sleeve 53 and post 47, accommodating rotation 79 about axis 77 of tensioner ring pin 69. As shown, the conical shape of post cylinder bore 49 accommodates motion of post 47 relative to cylinder pin 67. Post 47 may include a notch near a base of post 47 to accommodate a lower end of intermediate sleeve 53 when post 47 is at maximum tilt relative to intermediate sleeve 53 as shown in FIG. 4B. Loading of coupler 41 will be similar to that described above in that load will transfer from intermediate sleeve 53 to post 47 through tensioner ring pin 69. The relative surfaces of the contacting members will maintain contact such that the compressive loads applied to coupler 41 may be transferred as described above. In this manner, coupler 41 may rotate on the two axes 73, 77, allowing for two rotational degrees of freedom.

Figure 5:
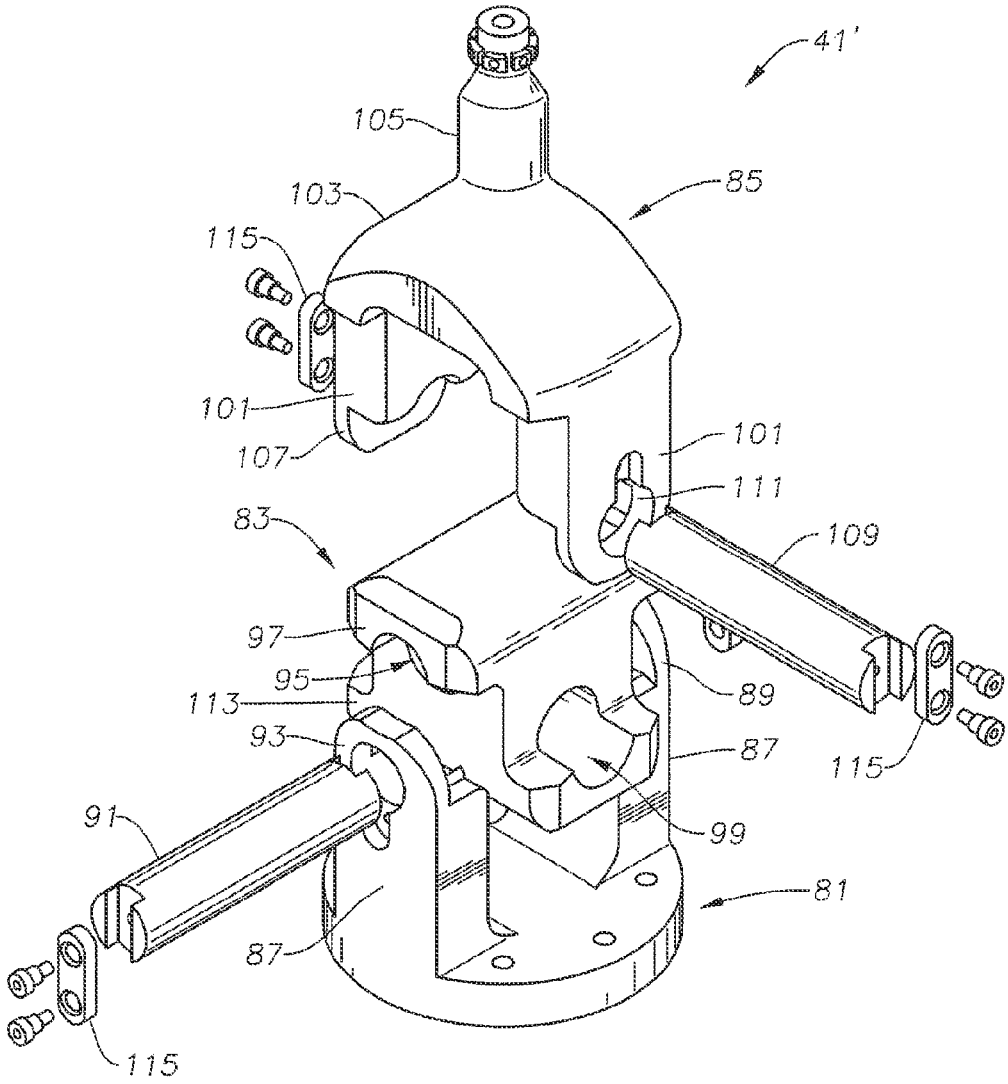
FIG. 5 is an alternative cylinder connector of the riser tensioner assembly of FIG. 1.

Referring to FIG. 5, an alternative coupler 41' is shown. Coupler 41' includes a cylinder adapter 81, an inner pivot 83, and an adapter latch assembly 85. Cylinder adapter 81 may be a circular plate similar to cylinder plate 45 of coupler 41. Cylinder adapter 81 mounts to an end of cylinder 19 and includes two posts 87 extending from a surface of cylinder adapter 81 opposite cylinder 19. Each post 87 may have a contoured end 89 adapted to receive a tensioner ring pin 91. The contour of end 89 biases tensioner ring pin 91 to a medial portion of end 89. Each post 87 also includes a lug 93 extending outwardly from end 89 on a periphery of end 89 so that an outer surface of lug 93 is flush with an outer surface of post 87 and an outer surface of cylinder adapter 81 that is perpendicular to the surface from which posts 87 protrude. Each lug 93 is configured to receive an end of tensioner ring pin 91 to prevent tensioner ring pin 91 from moving away from ends 89 and posts 87.

Inner pivot 83 may he a generally cuboid body having a width such that inner pivot 83 may fit between posts 87 with sufficient clearance between interior surfaces of posts 87 and exterior surfaces of inner pivot 83 to allow inner pivot 83 to move relative to posts 87. Inner pivot 83 may have a length such that a portion of inner pivot 83 may align with keyways 93 and a portion may be positioned between posts 87 below keyways 93. Inner pivot 83 includes a tensioner ring pin bore 95 aligned with the portion of inner pivot 83 that aligns with keyways 93, proximate to a top of inner pivot 83. Tensioner ring pin bore 95 may be a cylindrical bore passing through inner pivot 83. An axis of tensioner ring pin bore 95 may align with an axis of keyways 93 when coupler 41' is assembled. Tensioner ring pin bore 95 may have a diameter substantially equivalent to tensioner ring pin 91 so that tensioner ring pin 91 may pass through tensioner ring pin bore 95. In this manner, tensioner ring pin 91 may couple inner pivot 83 to posts 87 to that inner pivot 83 may pivot on the axis of tensioner ring pin 91 relative to posts 87 and cylinder adapter 81. A person skilled in the art will understand that outer surfaces of tensioner ring pin 91 may be in contact with inner surfaces of tensioner ring pin bore 95 so that the contacting surfaces may be a load bearing interface. In the illustrated embodiment, inner pivot 83 includes to support members 97 extending from opposite surfaces inner pivot 83 parallel to an axis of tensioner ring bore 95. Support members 97 may have ends configured to abut an interior surface of lug 93 and at least partially surround tensioner ring pin 91 opposite ends 89 of posts 87.

Inner pivot 83 includes a cylinder pin bore 99. Cylinder pin bore 99 passes through the portion of inner pivot 83 disposed between posts 87 and below tensioner ring bore 95, proximate to a bottom of inner pivot 83. In the illustrated embodiment, cylinder pin bore 99 is positioned so that an axis of cylinder pin bore 99 is perpendicular to the axis of tensioner ring bore 95. Cylinder pin bore 99 may be a cylindrical bore passing through inner pivot 83.

Adapter latch assembly 85 may be a yoke or fork like member having two prongs 101 extending from a base member 103. A coupling protrusion 105 extends from base member 103 opposite prongs 101 and is configured to couple to a tensioner ring similar to boss 71 of tensioner ring coupler 59. Each prong 101 may have a contoured end 107 adapted to receive a cylinder pin 109. The contour of end 107 biases cylinder pin 109 to a medial portion of end 107. Each prong 101 also includes a keyway 111 extending outwardly from end 107 on a periphery of end 107 so that an outer surface of keyway 111 is flush with an outer surface of prong 101 and an outer surface of base member 103. Each keyway 111 is configured to receive an end of cylinder pin 109 to prevent cylinder pin 109 from moving away from end 107 and prongs 101.

Cylinder pin bore 99 may have a diameter substantially equivalent to cylinder pin 109 so that cylinder pin 109 may pass through cylinder pin bore 99. In this manner, cylinder pin 1.09 may couple inner pivot 83 to prongs 101 so that inner pivot 83 may pivot on the axis of cylinder pin 109 relative to prongs 101 and adapter latch assembly 85. A person skilled in the art will understand that outer surfaces of cylinder pin 109 may be in contact with inner surfaces of cylinder pin bore 99 so that the contacting surfaces may be a load bearing interface. In the illustrated embodiment, inner pivot 83 includes two support members 113 extending from opposite surfaces of inner pivot 83 parallel to an axis of cylinder bore 99.

In the illustrated embodiment, coupler 41' includes anti-rotation keys 115. Anti-rotation keys 115 reside within cavities on opposite ends of tensioner ring pin 91 and cylinder pin 109. Anti-rotation keys 115 will include a portion extending into a matching cavity formed in the outer surfaces of prongs 101 and posts 87. Anti-rotation keys 115 may be secured to posts 87 and prongs 101 by any suitable means, such as with the illustrated screws. In this manner, anti-rotation keys 115 may prevent rotation of pins 91, 109 within keyways 93, 111, and secure pins 91, 109 to the cylinder adapter 81 and latch adapter assembly 85, respectively.

The coupling of cylinder adapter 81 to adapter latch assembly 85 allows coupler 41' to pivot on cylinder pin 109 for a first degree of rotation and on tensioner ring pin 91 for a second degree of rotation similar to coupler 41 while also transmitting loads from cylinder 19 as described above with respect to coupler 41 of FIGS. 2-4B.

Accordingly, the disclosed embodiments provide numerous advantages over prior art riser tensioners. For example, the disclosed embodiments provide a push up riser tensioner that can accommodate large loads on a tension leg platform (TLP) using a coupler with multiple rotational degrees of freedom at the coupling of the cylinder with the tensioner ring. In addition, the disclosed embodiments are less prone to corrosion issues due to their placement above the tension leg platform deck rather than below. This also reduces the need for additional deck structure to support the riser tensioner. The disclosed embodiments also eliminate high pressure accumulation while using a smaller number of cylinders.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A tensioner for maintaining a tensile force in a riser having an axis and extending from a subsea wellhead assembly through an opening in a floating platform deck, the tensioner comprising:

a tensioner ring adapted to be coupled to the riser;

a plurality of hydro-pneumatic cylinder assemblies, each having a flexible coupler on each end for coupling each of the cylinder assemblies between the deck and the tensioner ring;

wherein the flexible coupler on at least one of the ends of each of the cylinder assemblies comprises a cylinder end member coupled to one of the ends of one of the cylinder assemblies;

an intermediate member pivotally coupled to the cylinder end member by a first pin; and an adapter selectively mountable to the deck or to the tensioner ring and pivotally coupled to the intermediate member by a second pin, the first pin and the second pin spaced apart and perpendicular to each other so that the adapter may pivot on the second pin relative to the intermediate member and the cylinder end member may pivot on the first pin relative to the intermediate member.

2. The tensioner of claim 1, wherein the cylinder end member of each of the flexible couplers comprises a post extending along an axis of said one of the cylinder assemblies;

the intermediate member of each of the flexible couplers comprises an inner sleeve disposed around and pivotally coupled to the post by the first pin to form a post annulus between the post and the inner sleeve; and the adapter of each of the flexible couplers comprises an outer sleeve defining a cavity into which the post and inner sleeve are inserted so that an outer annulus is formed between the inner sleeve and the outer sleeve, the outer sleeve being pivotally coupled to the inner sleeve by the second pin.

3. The tensioner of claim 1, wherein the cylinder end member of each of the flexible couplers comprises two posts extending from the cylinder end member opposite the cylinder assembly;

the intermediate member of each of the flexible couplers comprises an inner pivot positioned between the posts of the cylinder end member, the first pin passing through the posts and the inner pivot; and the adapter of each of the flexible couplers comprises two prongs extending from a base member and a protrusion extending from the base member opposite the prongs, the second pin passing through the prongs and the inner pivot.

4. A tensioner for maintaining a tensile force in a riser having an axis and extending from a subsea wellhead assembly through an opening in a floating platform deck, the tensioner comprising:

a tensioner ring adapted to be coupled to the riser;

a plurality of hydro-pneumatic cylinder assemblies, each having a flexible coupler on each end for coupling each of the cylinder assemblies between the deck and the tensioner ring;

wherein each flexible coupler comprises a post extending along an axis of one of the cylinder assemblies;

an inner sleeve disposed around and pivotally coupled to the post to form a post annulus between the post and the inner sleeve;

an outer sleeve defining a cavity into which the post and the inner sleeve are inserted so that an outer annulus is formed between the inner sleeve and the outer sleeve;

the outer sleeve being pivotally coupled to the inner sleeve so that outer sleeve may pivot relative to the inner sleeve; and the inner sleeve being pivotally coupled to the post so that the inner sleeve may pivot relative to the post.

5. The tensioner of claim 4, wherein:

the post of each of the flexible couplers has a post tensioner ring bore passing through the post, the post tensioner ring bore having an axis perpendicular to the axis of said one the cylinder assemblies;

the inner sleeve of each of the flexible couples has a sleeve tensioner ring bore passing through the inner sleeve, the post tensioner ring bore and the sleeve tensioner ring bore being coaxial; and wherein each of the flexible couplers comprises:

a tensioner pin having diameter substantially equivalent to a diameter of the sleeve tensioner ring bore and the post tensioner ring bore, the tensioner pin passing through the post tensioner ring bore and the sleeve tensioner ring bore so that the inner sleeve may pivot on the tensioner pin relative to the post.

6. The tensioner of claim 4, wherein:

the post of each of the flexible couplings has a post cylinder bore passing through the post, the post cylinder bore having an axis perpendicular to the axis of said one of the cylinder assemblies;

the inner sleeve of each of the flexible couplings has a sleeve cylinder bore passing through the inner sleeve, the post cylinder bore and the sleeve cylinder bore being coaxial;

the outer sleeve of each of the flexible couplings has a coupler cylinder bore passing through the outer sleeve, the coupler cylinder bore being coaxial with the post cylinder bore and the sleeve cylinder bore; and wherein each of the flexible couplers comprises:

a cylinder pin having a diameter substantially equivalent to a diameter of the coupler cylinder bore and the sleeve cylinder bore, the cylinder pin passed through the post cylinder bore, the sleeve cylinder bore, and the coupler cylinder bore so that the outer sleeve may pivot on the cylinder pin.

7. The tensioner of claim 4, wherein:

the post has a post tensioner ring bore passing through the post and a post cylinder bore passing through the post, the post tensioner ring bore having an axis that is perpendicular to an axis of the post cylinder bore;

the inner sleeve has a sleeve tensioner ring bore passing through the sleeve and a sleeve cylinder bore passing through the sleeve, the post tensioner ring bore and the sleeve tensioner ring bore being coaxial, and the post cylinder bore and the sleeve cylinder bore being coaxial;

the outer sleeve has a coupler cylinder bore passing through the outer sleeve, the coupler cylinder bore being coaxial with the sleeve cylinder bore and the post tensioner ring bore; wherein each of the flexible couplers further comprises:

a tensioner pin having a diameter substantially equivalent to a diameter of the sleeve tensioner ring bore and the post tensioner ring bore, the tensioner pin passing through the post tensioner ring bore and the sleeve tensioner ring bore so that the inner sleeve may pivot on the tensioner pin relative to the post; and a cylinder pin having a diameter substantially equivalent to a diameter of the coupler cylinder bore and the sleeve cylinder bore, the cylinder pin passing through the post cylinder bore, the sleeve cylinder bore, and the coupler cylinder bore so that the outer sleeve may pivot on the cylinder pin.

8. The tensioner of claim 7, wherein the post cylinder bore has a first diameter at a medial portion of the post cylinder bore and a second diameter at distal ends of the post cylinder bore, the post cylinder bore having a conical surface extending from the medial portion to each distal end.

9. The tensioner of claim 8, wherein the cylinder pin is configured to pivot at an angle to the axis of the post cylinder bore.

10. The tensioner of claim 4, wherein the outer sleeve has a conical recess formed in an inner diameter herein, the conical recess receiving a portion of the inner sleeve when the outer sleeve pivots relative to the inner sleeve.

11. The tensioner of claim 4, wherein the outer sleeve comprises:

a cylindrical member having an open end and a closed end, the open end proximate to one of the cylinder assemblies when the outer sleeve is coupled to the inner sleeve and the post; and a boss coupled to an exterior surface of the closed end, the boss configured to couple to the tensioner ring.

12. A tensioner for maintaining a tensile force in a riser having an axis and extending from a subsea wellhead assembly through an opening in a floating platform deck, the tensioner comprising:

a tensioner ring adapted to be coupled to the riser;

a plurality of hydro-pneumatic cylinder assemblies, each of the cylinder assemblies having a flexible coupler on each end for coupling the cylinder assemblies between the deck and the tensioner ring;

wherein the flexible coupler on at least one of the ends of each of the cylinder assemblies comprises a cylinder adapter coupled to one of the ends of one of the cylinder assemblies and having two lugs extending from the cylinder adapter opposite said one of the cylinder assemblies;

an inner pivot positioned between the lugs of the cylinder adapter;

a first pin passing through the lugs and the inner pivot;

an adapter latch assembly having two prongs extending from a base member and a protrusion extending from the base member opposite the prongs, the adapter latch assembly adapted to be mounted selected to the deck or the tensioner ring;

a second pin passing through the prongs; and wherein the first pin and the second pin are spaced apart and perpendicular to each other so that the cylinder adapter may pivot on the first pin relative to the inner pivot and the adapter latch assembly may pivot on the second pin relative to the inner pivot.

13. The tensioner of claim 12, wherein the cylinder adapter further comprises:

a circular plate, the posts extending outward from peripheral portions of the plate opposite said one of the cylinder assemblies; and the posts having contoured ends configured to receive a portion of the first pin.

14. The tensioner of claim 12, wherein the inner pivot comprises:

a body having a first pin bore passing therethrough and a second pin bore passing therethrough, the first pin bore and the second pin bore being perpendicular to each other; and first pin bore support members extending outward relative to an axis of the first pin bore from an outer surface of the body proximate to the first pin bore, and second pin bore support members extending outward relative to an axis of the second pin bore from an outer surface of the body proximate to the second pin bore, the first pin bore support members having curved, contoured surfaces to receive a portion of the first pin, and the second pin bore support members having curved contoured surfaces to receive a portion of the second pin.

15. The tensioner of claim 12, wherein:

the prongs have curved, contoured ends and openings configured to receive a portion of the second pin.

16. The tensioner of claim 12, further comprising anti-rotation keys engaging at least one of the first pin and the second pin to prevent rotation of the first pin and the second pin relative to the posts and the prongs, respectively.

17. A method applying tension to a riser extending through a deck of a floating offshore platform, the method comprising:

a. mounting a tensioner assembly having a plurality of hydro-pneumatic cylinder assemblies between the deck and the riser;

b. providing an articulated coupling at each end of each of the cylinder assemblies, at least one of the articulated couplings on each of the cylinder assemblies having a cylinder end member mounted to one of the ends of one of the cylinder assemblies, an intermediate member pivotally coupled to the cylinder end member by a first pin, and an adapter member pivotally coupled to the intermediate member by a second pin, the first pin and the second pin being spaced apart from and perpendicular to each other, and mounting the adapter member selectively to the riser or the deck; and c. in response to relative motion between the riser and the platform, pivoting each of the cylinder assemblies about the first pin and the second pin.

18. The method of claim 17, further comprising connecting the adapter member to the riser.

19. The method of claim 17, further comprising providing an articulated coupling for both of the ends of each of the cylinder assemblies.

* * * * *